US006964234B2

(12) United States Patent
Chang

(10) Patent No.: US 6,964,234 B2
(45) Date of Patent: Nov. 15, 2005

(54) COMPUTER DESK

(76) Inventor: Chien-Kuo Chang, P.O. Box 36-80, Taichung City (TW)

( * ) Notice: Subject to any disclaimer, the term of this patent is extended or adjusted under 35 U.S.C. 154(b) by 27 days.

(21) Appl. No.: 10/687,394

(22) Filed: Oct. 15, 2003

(65) Prior Publication Data

US 2005/0081761 A1 Apr. 21, 2005

(51) Int. Cl.[7] ..... A47B 57/00
(52) U.S. Cl. ..... 108/50.01; 108/101
(58) Field of Search ..... 108/50.01, 50.02, 108/92, 93, 96, 101, 106, 107, 108, 184, 108/180, 147.11; 312/223.3, 9.1, 5.9, 196; 211/180, 184; D6/629, 630; 248/165

(56) References Cited

U.S. PATENT DOCUMENTS 4,646,655 A * 3/1987 Robolin ..... 108/92
5,357,873 A * 10/1994 Hilton ..... 108/50.01
5,694,862 A * 12/1997 Grubb ..... 108/50.11
D396,597 S * 8/1998 Hollinger ..... D6/629
6,220,180 B1 * 4/2001 Janowitz ..... 108/50.01
6,374,754 B1 * 4/2002 Chang ..... 108/92
6,398,326 B1 * 6/2002 Wang ..... 312/223.3
D472,753 S * 4/2003 Udonmahuntisuk ..... D6/630
6,732,660 B2 * 5/2004 Dame et al. ..... 108/50.01
6,824,230 B2 * 11/2004 Probst ..... 312/223.3
2004/0173125 A1 * 9/2004 Chang ..... 108/50.01

FOREIGN PATENT DOCUMENTS

GB 2348361 * 4/2000

* cited by examiner

*Primary Examiner*—Janet M. Wilkens
(74) *Attorney, Agent, or Firm*—Charles E. Baxley

(57) ABSTRACT

A computer desk, includes two vertical rods with an optical disk rack installed on one of the vertical rods. The optical disk rack includes an external arc panel, with several optical disk slots horizontally disposed on the external arc panel. A rear rod is mounted on the rear side of the external arc panel at a position corresponding to the area of the optical disk slots. A plurality of frames are fixed between two vertical rods with a board installed on each frame. One of the vertical rods has a main system retainer.

10 Claims, 5 Drawing Sheets

COMPUTER DESK

BACKGROUND OF THE INVENTION

1. Field of the Invention

The present invention relates to a computer desk, more particularly to a computer desk assembly having a plurality of layers for placing objects.

2. Description of the Related Art

Computer and its peripherals have gained a high popularity in many developed countries, and thus computer desks are of high demand for placing computer and its peripherals. There are various models for the consumer's choice to place computer equipments and allow users to sit comfortably in front of the computer desk for an easy, convenient, and pleasant operation. In order to accommodate more computer equipments within a limited space, a multiple-layer structure is adopted and such structure has become the present mainstream design for computer desks.

SUMMARY OF THE INVENTION

The primary objective of the present invention is to provide a computer desk structure having a plurality of layers for accommodating computer equipments, and to give a novel space configuration to computer desks. Such computer desk emphasizes on its secure connection of the framework to enhance the strength and stability of the entire computer desk.

The technical characteristics of this invention to accomplish the foregoing objective comprise two vertical rods, each being a hollow straight rod and having an expanded base at its bottom; at least one optical disk rack, having an external arc panel and a rear rod, wherein the vertical rod passing through and being fixed to the top and the bottom of the external arc panel; a plurality of horizontal optical disk slots being disposed on the external arc panel; and the rear rod being fixed on the rear side of the external arc panel at the position corresponding to the optical disk slot; a plurality of frame fixing holes, each including a large hole and a small hole being concentrically disposed on the rod surface of the vertical rod; a plurality of frames, having two protruded fixing ends for sealing and a threaded hole, and the fixing end with its diameter passing through the large hole of the two vertical rods into the interior of the vertical rod, and a fixture being passed into the small hole to mount the frame.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
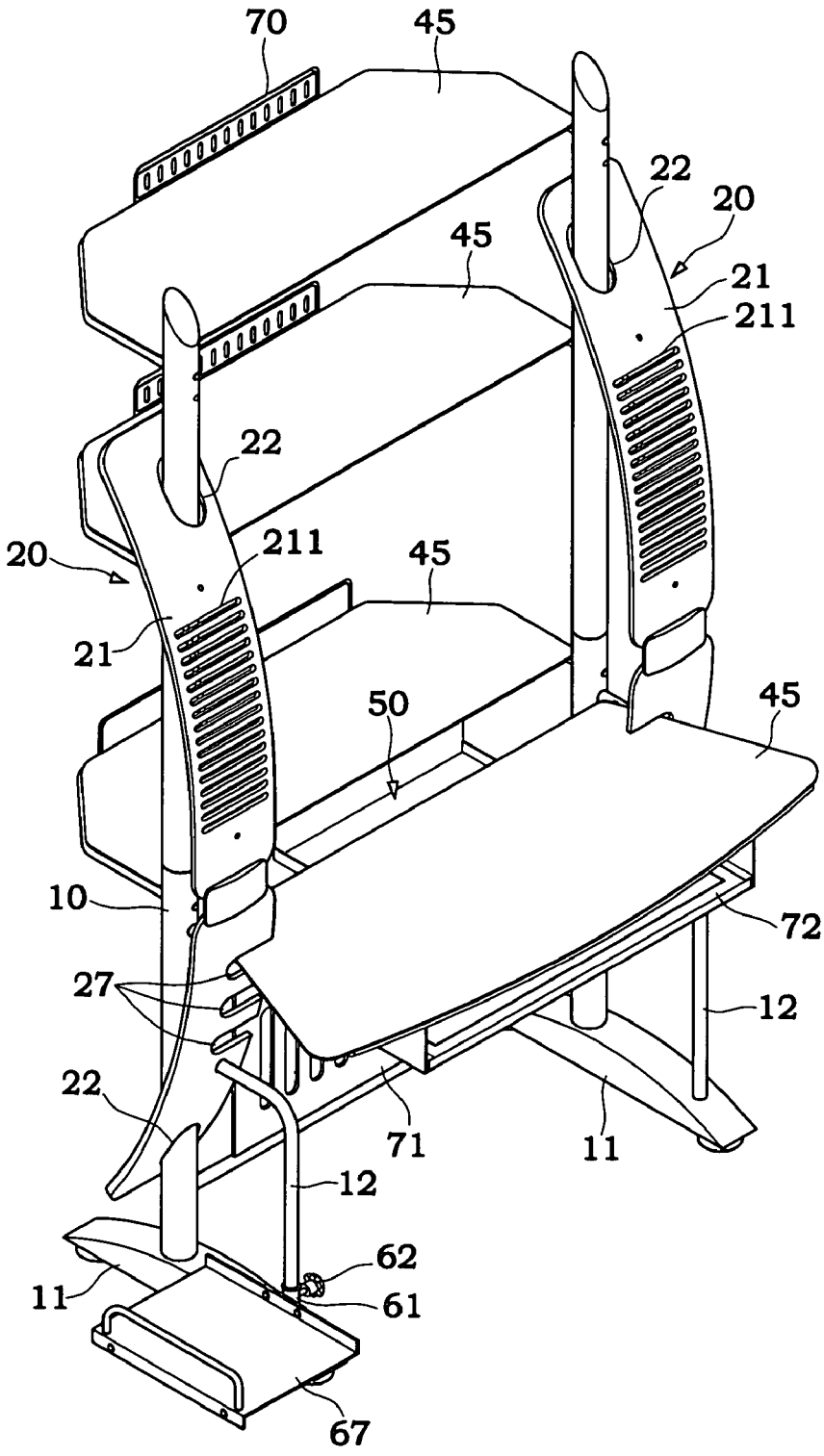
FIG. 1 is a perspective diagram of the present invention.
Figure 2:
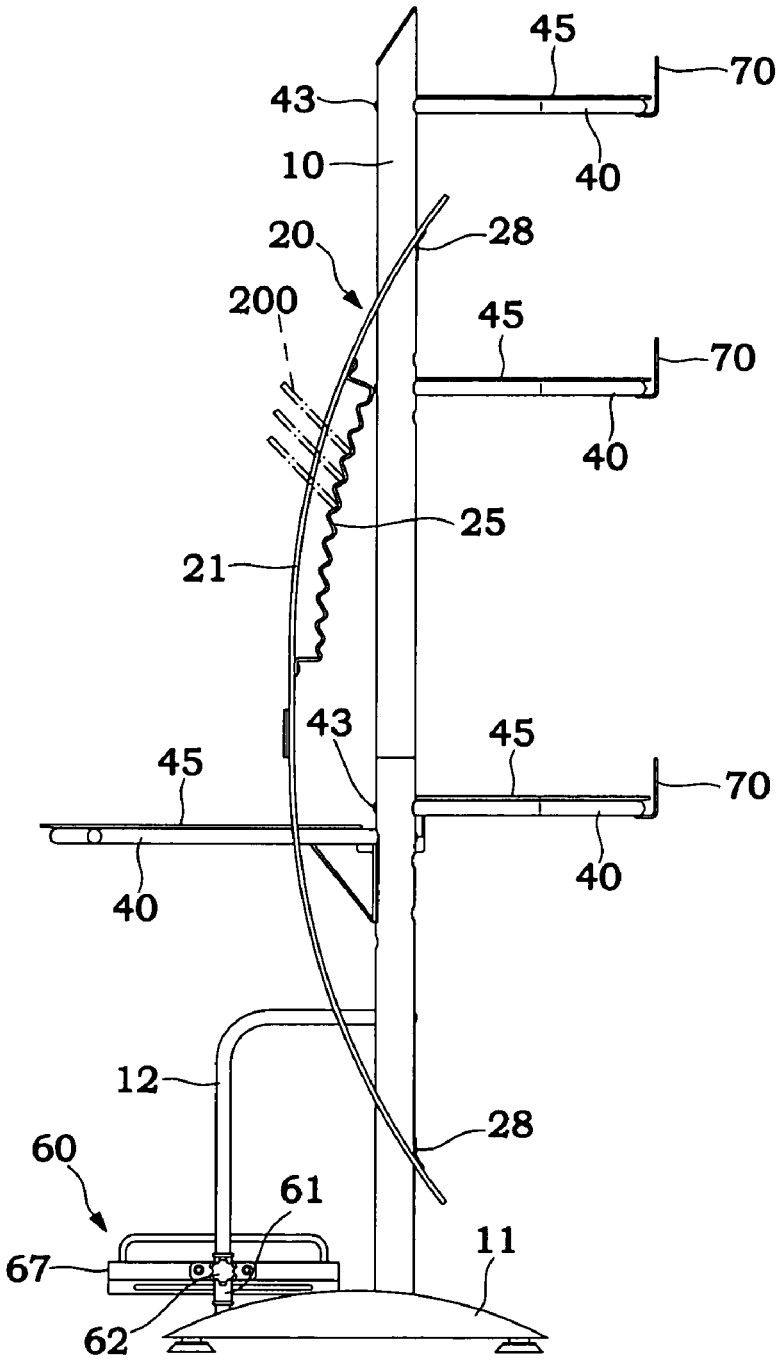
FIG. 2 is a side-view diagram of the present invention.
Figure 3:
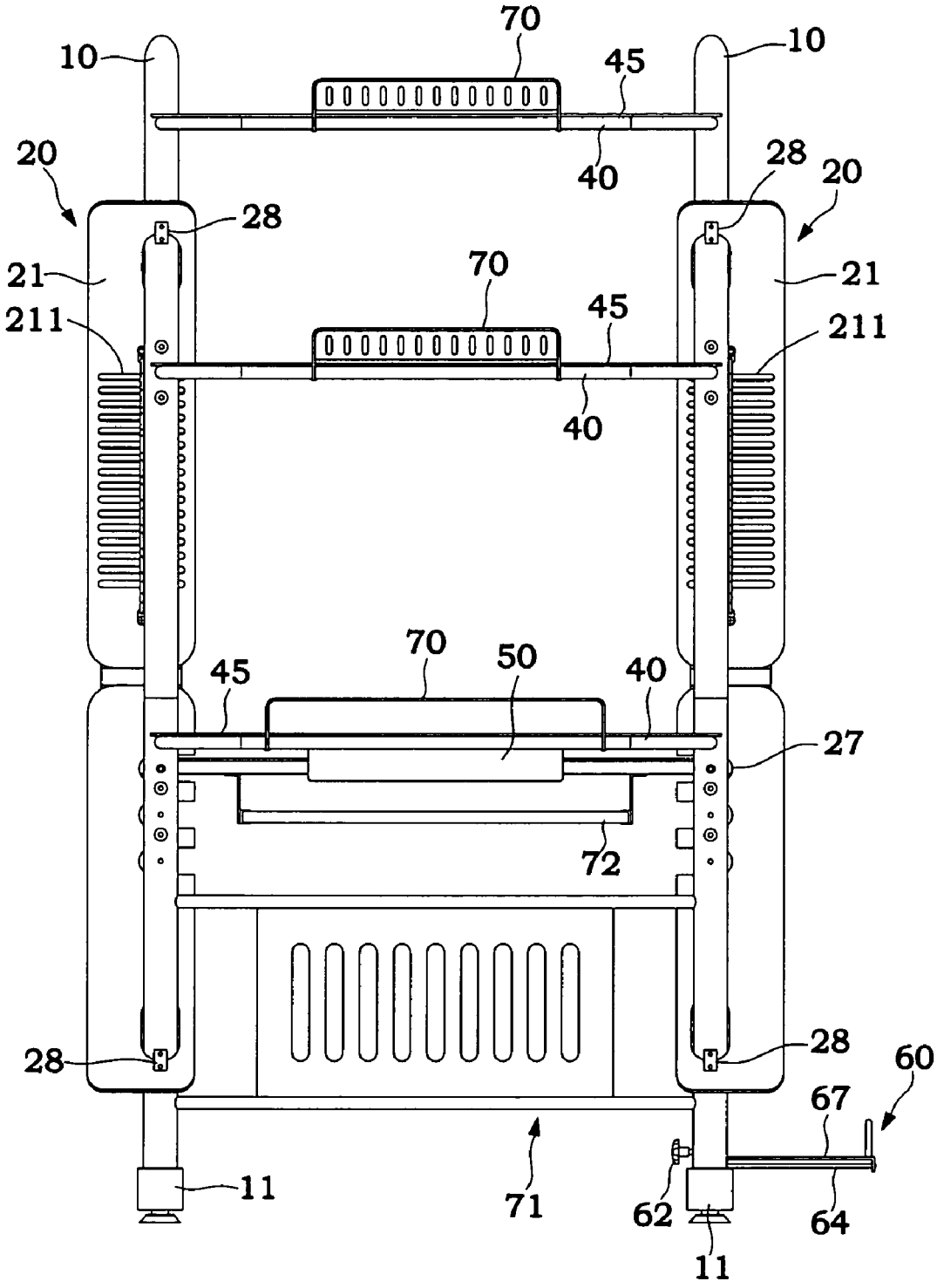
FIG. 3 is a rear-view diagram of the present invention.

Please refer to FIGS. 1 to 3. In the figures, two vertical rods 10 are hollow straight rods, each having an expanded base 11 at its bottom for securing the erection of the two vertical rods.

Figure 5:
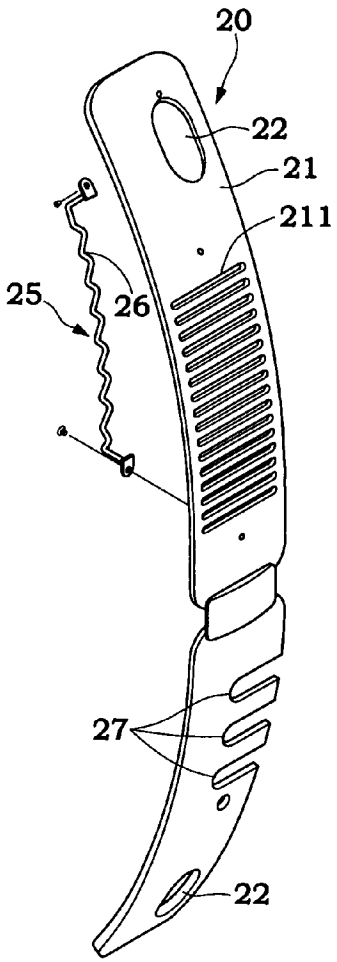
FIG. 5 is a perspective diagram of the disassembled part of the optical disk racking according to the present invention.

Refer to FIGS. 1, 2, and 5 for two optical disk racks 20, each rack 20 comprising an external arc panel 21 and a rear rod 25. The external arc panel 21 has a vertical rod through hole 22 at each of its upper and lower ends for letting the vertical rod 10 pass through, and two fixtures 28 adjacent to the rear side of the external arc panel 21 and the vertical rod 10 to fix the external arc panel 21 onto the vertical rod 10. A plurality of horizontal optical disk slots 211 is disposed on the external arc panel 21 for accommodating an optical disk with its protective box 200. In the meantime, the upper section of the rear side of the external arc panel is fixed onto the rear rod 25. The rear rod 25 is substantially in a curved shape, and the rod body is composed of successive turnings to define a retaining section 26 at the position corresponding to the optical disk slot 211, and support the insertion of the optical disk 200 from the rear into the optical disk slot 211.

Figure 4:
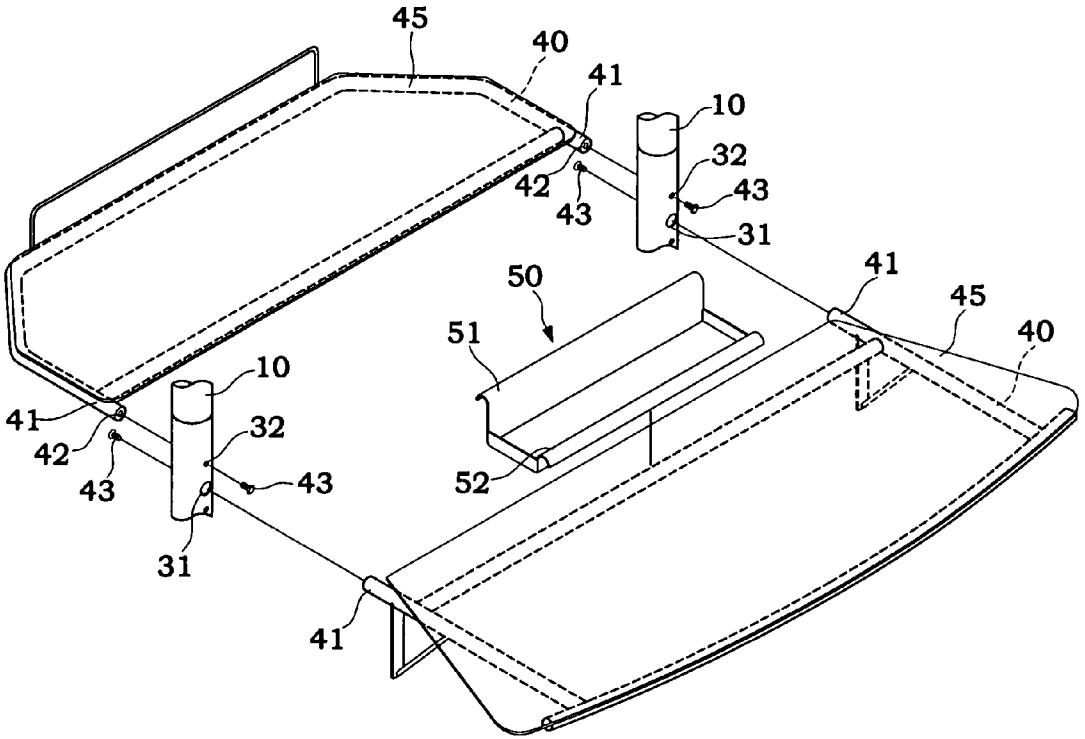
FIG. 4 is a perspective diagram of the assembled parts including the frame, miscellaneous box, and vertical rod according to the present invention.
Figure 7:
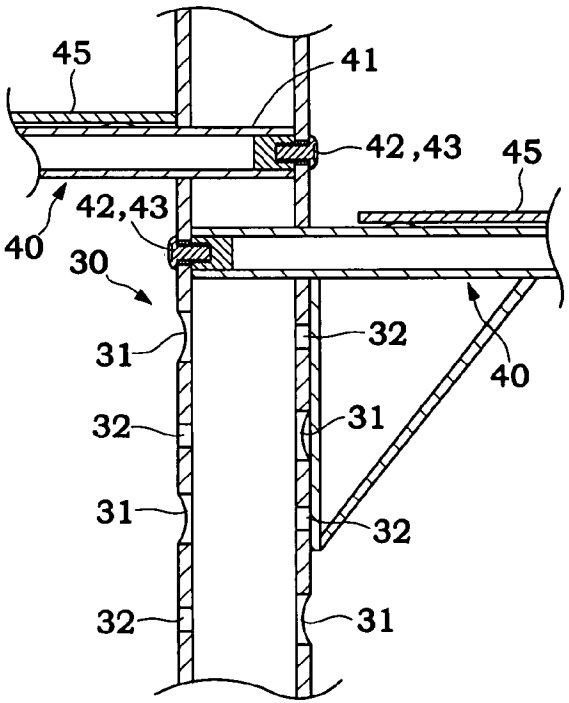
FIG. 7 is a cross-sectional diagram of part of the frame, and frame fixing hole according to the present invention.

Please refer to FIGS. 4 and 7 for a plurality of frame fixing holes 30, each comprising a large hole 31 and a small hole 32 concentrically disposed on the rod surface of the vertical rod 10.

Please refer to FIGS. 4 and 7 for a plurality of frames 40, each having two protruded fixing ends 41, and each protruded fixing end 41 is closed and has a threaded hole 42. The fixing end 41 with its diameter passes through the large hole 31 of the two vertical rods 10 into the interior of the vertical rod 10, and a screw 43 passes through the small hole 32 to mount the frame 40. The position of the frame 40 is set at a position corresponding to the frame fixing hole 30, and each frame is fixed to an object placing board 45 by the prior art technology to create an accommodating space with different heights and positions.

Please refer to FIGS. 1 and 4 for a miscellaneous box 50, which is a box body with a rectangular open top, and has a hanging edge 51, 52 on the front and rear sides for being hung on the frame edge of the frame 40 at the corresponding positions in the front and at the rear respectively to store miscellaneous items such as pens and stationeries.

Figure 6:
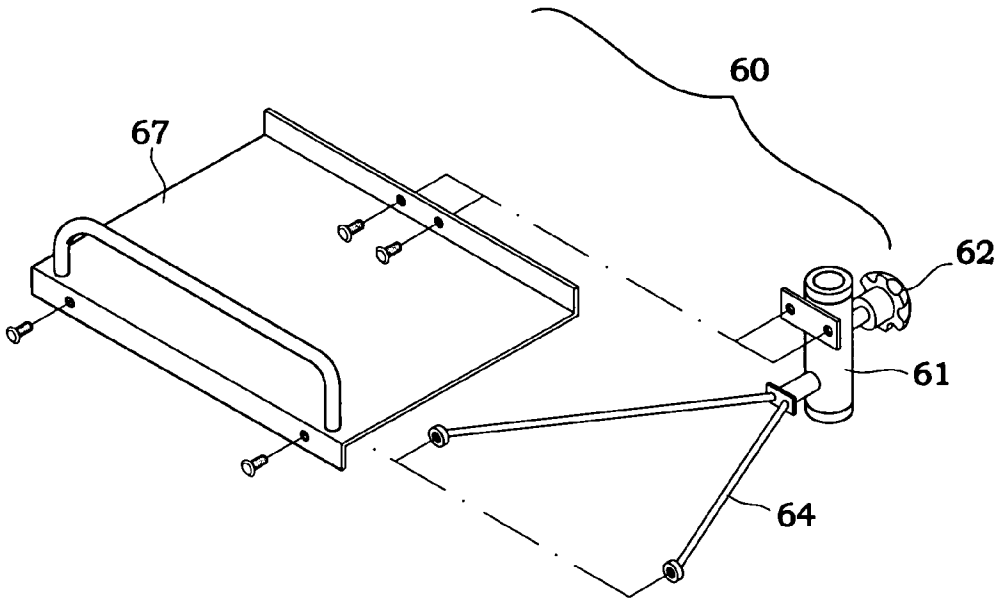
FIG. 6 is a perspective diagram of the disassembled parts of the main system base according to the present invention.

Please refer to FIGS. 1 and 6 for a main system base 60, comprising an adjusting member 61, a support rack 64, and a retaining board 67. The adjusting member 61 is a cylindrical structure sheathed into the bottom of the vertical rod 10 or disposed on a secondary rod 12 of the vertical rod 10, and an adjusting screw bolt 62 is disposed at the radial direction of the adjusting member 61 to press against the rod surface of the vertical rod 10 or against the secondary rod 12 in order to fix the adjusting member 61. The support rack 64 is in a forked shape, with its intersected end coupled to the adjusting member 61, and the open end of the fork-shaped support rack 64 is disposed on the bottom of the retaining board 67, such that the entire support rack supports the retaining board 67.

By means of the design of the foregoing structure, the inventor invented the computer desk as shown in FIG. 1. In FIGS. 1, 2, and 3, the computer desk according to the preferred embodiments of this invention comprises an optical disk rack 20 disposed on each of the two vertical rods 10, two object placing boards 45 (or called the upper board) disposed at the rear between the upper section of the vertical rod 10, an object placing board (or called the lower board) disposed at a lower position of the main object placing board in the front of the two vertical rods 10, and a plurality of openings 27 reserved on the appropriate position of the external arc panel 21 corresponding to the main desk board 10 for accommodating the engagement of the main desk board 10. A blocking panel 70 is disposed on the back side of the upper board to prevent objects from falling down. A miscellaneous box 50 is disposed between the main desk board and the main object placing rack; since there is a difference between the heights of the main desk board and the main object placing rack, therefore the front and rear hanging edges 51, 52 of the miscellaneous box 50 are of the different heights for being hung onto the edge of the corresponding frames 40 of the main desk board and main object placing rack. Further, the foregoing main system retainer 60 is disposed on the outer side of the bottom of a main rod 10. In addition, a reinforced structure 71 is disposed at the lower section between the two vertical rods 10 for improving the stability of the two vertical rods. A keyboard tray 72 can be added below the main desk board.

The frame fixing hole 30 according to the present invention uses a large hole 31 to pass through the fixing end 41 of the frame 40, such that the fixing end 41 obtains the support from the edge of the hole, and reduces the load of the screw member 43 to improve the stability of the connection between the vertical rod 10 and frame 40.

While the present invention has been described by the most practical and preferred embodiments, it is understood that this invention is not limited to the disclosed embodiments but is intended to cover various arrangements included within the spirit and scope of the broadest interpretations and equivalent arrangements.

What is claimed is:

1. A computer desk comprising:

two vertical rods;

an arc panel optical disk rack having a rear rod, with said arc panel attached to at least one of said vertical rods, and a plurality of frames each with two protruding ends attached to a respective vertical rod.

2. The computer desk of claim 1, wherein said rear rod of the optical disk rack comprises an arc rod body corresponding to said arc panel.

3. The computer desk of claim 2, wherein said rod body of the rear rod comprises a plurality of successive turnings to define a support section corresponsive to each optical disk slot.

4. The computer desk of claim 1, further comprising a main system retainer.

5. The computer desk of claim 4, wherein said main system retainer comprises an adjusting member, a support rack, and a retaining board; said adjusting member being sheathed into the bottom of one of said vertical rods and an adjusting screw bolt pressing at the radial direction against the rod surface of said vertical rod; and one end of said support rack being coupled to said adjusting member, and the other end extending outward to couple with the bottom of said retaining board such that the whole support rack supporting said retaining board.

6. The computer desk of claim 5, wherein said support rack is a forked rod with its end of intersection coupled to said adjusting member, and the open end of said forked support rack is coupled under said retaining board.

7. The computer desk of claim 1, wherein said two vertical rods have a object placing board substantially disposed at the center of the rear side of said two vertical rods with said object placing board constitute a first object placing board and further comprising a frame and a second object placing board with a frame being disposed at a position lower than said first object placing board at the front side of said two vertical rods.

8. The computer desk of claim 7, further comprising a miscellaneous box, being hung on a frame edge of the frames of said first object placing board and said second object placing board.

9. The computer desk of claim 8, wherein said miscellaneous box is a box body with a rectangular open top, and has a hanging edge each on the front and rear sides.

10. The computer desk of claim 7, wherein said arc panel includes a plurality of openings at the positions corresponding to said second object placing board for letting said second object placing board pass through.

* * * * *